US007819641B2

(12) United States Patent
Decker et al.

(10) Patent No.: US 7,819,641 B2
(45) Date of Patent: Oct. 26, 2010

(54) REVERSE FLOW COOLING FOR FAN MOTOR

(75) Inventors: John Decker, Cypress, TX (US); Chellappa Balan, Niskayuna, NY (US); Ralph J. Carl, Jr., Clifton Park, NY (US); John Miller, San Luis Obispo, CA (US); Dennis M. Pfister, San Luis Obispo, CA (US)

(73) Assignee: Xcelaero Corporation, San Luis Obispo, CA (US)

( * ) Notice: Subject to any disclaimer, the term of this patent is extended or adjusted under 35 U.S.C. 154(b) by 553 days.

(21) Appl. No.: 11/714,668

(22) Filed: Mar. 5, 2007

(65) Prior Publication Data

US 2008/0219844 A1 Sep. 11, 2008

(51) Int. Cl.
*F04D 29/58* (2006.01)

(52) U.S. Cl. ..... 417/370; 417/369; 417/423.5; 417/423.8

(58) Field of Classification Search ..... None
See application file for complete search history.

(56) References Cited

U.S. PATENT DOCUMENTS

| | | | | | |
|---|---|---|---|---|---|
| 1,932,231 | A | * | 10/1933 | Schmidt | 417/360 |
| 2,596,783 | A | | 5/1952 | Moore | |
| 3,734,649 | A | * | 5/1973 | Sandy, Jr. | 417/370 |
| 4,275,321 | A | * | 6/1981 | Shimamoto et al. | 310/59 |
| 4,981,414 | A | | 1/1991 | Sheets | |
| 6,011,331 | A | | 1/2000 | Gierer et al. | |
| 6,031,721 | A | | 2/2000 | Bhatia | |
| 6,342,741 | B1 | | 1/2002 | Fukui et al. | |
| 6,581,241 | B2 | | 6/2003 | Shaver et al. | |
| 6,700,235 | B1 | | 3/2004 | McAfee | |
| 6,828,700 | B2 | | 12/2004 | Cichetti, Sr. | |
| 6,914,352 | B2 | | 7/2005 | Hoppe | |
| 6,927,509 | B2 | | 8/2005 | Cichetti, Sr. | |
| 7,168,918 | B2 | | 1/2007 | Balan et al. | |
| 2003/0194327 | A1 | | 10/2003 | Bradbury et al. | |
| 2006/0237168 | A1 | | 10/2006 | Belady et al. | |

FOREIGN PATENT DOCUMENTS

| | | | |
|---|---|---|---|
| EP | 0921318 | B1 | 5/2004 |
| WO | WO 2004/023628 | A1 | 3/2004 |
| WO | WO 2005/050819 | A2 | 6/2005 |

* cited by examiner

*Primary Examiner*—Devon C Kramer
*Assistant Examiner*—Philip Stimpert
(74) *Attorney, Agent, or Firm*—Henry C. Query, Jr.

(57) ABSTRACT

An air mover, such as a cooling fan, comprises a motor and an impeller which is driven by the motor to generate a flow of air through a flowpath. The motor comprises at least one inlet opening and at least one outlet opening, each of which is in fluid communication with the flowpath. In operation of the air mover, a pressure difference between the inlet and outlet openings causes a portion of the flow of air to flow into the inlet opening, through the motor and out the outlet opening to thereby cool the motor.

11 Claims, 6 Drawing Sheets

REVERSE FLOW COOLING FOR FAN MOTOR

BACKGROUND OF THE INVENTION

The present invention relates to a vane axial air mover which comprises a motor that drives an impeller to generate a flow of air through a flow path. More particularly, the invention relates to such an air mover which uses the pressure difference between the upstream and downstream ends of the flow path to cause a portion of the air to flow back through the motor in order to cool the motor.

Air movers typically include an electric motor which spins an impeller to generate a flow of air through a defined flow path. In certain types of air movers, such as axial fans, the motor is positioned in the flow path. However, since the size of the motor is largely driven by thermal concerns and its life is limited by the temperature capability of available insulation materials, fitting a motor with sufficient shaft power inside an optimal flow path is often a challenge. Consequently, the ability to dissipate heat from the motor is a design-limiting factor.

In some prior art fans, the motors are often cooled by air which is supplied by either an external blower or an internal fan. However, for low to medium power fans, the use of an external blower is not practical. Also, while internal fans can be somewhat effective in cooling the motor, they take up space and require a volume of air to draw from. Furthermore, although motors which are integrated into the axial fan assembly do dissipate some of their heat to the flow of air in the flow path due to "air over" cooling, the thermal resistance this heat dissipation path presents to the internal heat-generating motor components, such as coils, bearings, power electronics and rotor conductors, is very large.

SUMMARY OF THE INVENTION

In accordance with the present invention, these and other disadvantages in the prior art are addressed by providing an air mover which comprises a motor and an impeller which is driven by the motor to generate a flow of air through a flow path. The motor comprises at least one inlet opening and at least one outlet opening, each of which is in fluid communication with the flow path. Thus, during operation of the air mover, a pressure difference between the inlet and outlet openings causes a portion of the air to flow into the inlet opening, through the motor and out the outlet opening to thereby cool the motor.

In one embodiment of the invention, the motor is supported in a fan housing which defines an outer boundary of the flow path. In addition, the motor comprises a motor housing which is connected to the fan housing, a front end cap which is connected to an upstream end of the motor housing and a rear end cap which is connected to a downstream end of the motor housing. Moreover, the inlet opening is formed in the rear end cap and the outlet opening is formed in the front end cap.

In another embodiment of the invention, the air mover also comprises a tail cone which is connected to the motor adjacent the rear end cap, and the inlet opening communicates with the flow path through at least one aperture which extends through the tail cone. For example, the tail cone may include a first end which is connected to the motor adjacent the rear end cap, a second end which is located downstream of the first end and an outer surface which converges from the first end toward the second end, and the aperture may extend axially through the second end.

In yet another embodiment of the invention, the impeller is connected to the motor adjacent the front end cap, and the outlet opening communicates with the flow path through a space defined between the impeller and the front end cap. For example, the motor housing may comprise a front extension which is received within a recess in the impeller, and the outlet opening may communicate with the flow path through an annular space defined between the front extension and the recess.

In a further embodiment of the invention, the motor comprises a rotor which is connected to the impeller. In addition, the inlet opening is formed in a downstream portion of the rotor, the outlet opening is formed in an upstream portion of the rotor, and the inlet and outlet openings are connected by a flow bore which extends axially through the rotor. In this embodiment, the outlet opening may be connected to the flow path through a space defined between the impeller and the front end cap, or through one or more holes which extend through the impeller.

In accordance with the present invention, therefore, the motor is cooled by a flow of air which is drawn through the motor in a direction opposite to that of the main flow of air through the fan. This is made possible by utilizing the pressure difference that exists between the upstream and downstream ends of the flow path, which is especially pronounced in a fan which includes an outlet guide vane assembly and a diffuser section that convert the dynamic pressure generated by the impeller into a static pressure head. The use of this reverse flow cooling technique enables the size of the motor to be minimized. Consequently, the motor may be capable of fitting inside a flow path that would otherwise be too small for a motor cooled by conventional means.

These and other objects and advantages of the present invention will be made apparent from the following detailed description, with reference to the accompanying drawings. In the drawings, the same reference numbers are used to denote similar components in the various embodiments.

DETAILED DESCRIPTION OF THE INVENTION

The present invention is applicable to a variety of air movers, such as fans and compressors. However, for purposes of brevity it will be described in the context of an exemplary vane-axial cooling fan. Nevertheless, the person of ordinary skill in the art will readily appreciate how the teachings of the present invention can be applied to other types of air movers. Therefore, the following description should not be construed to limit the scope of the present invention in any manner.

Figure 1:
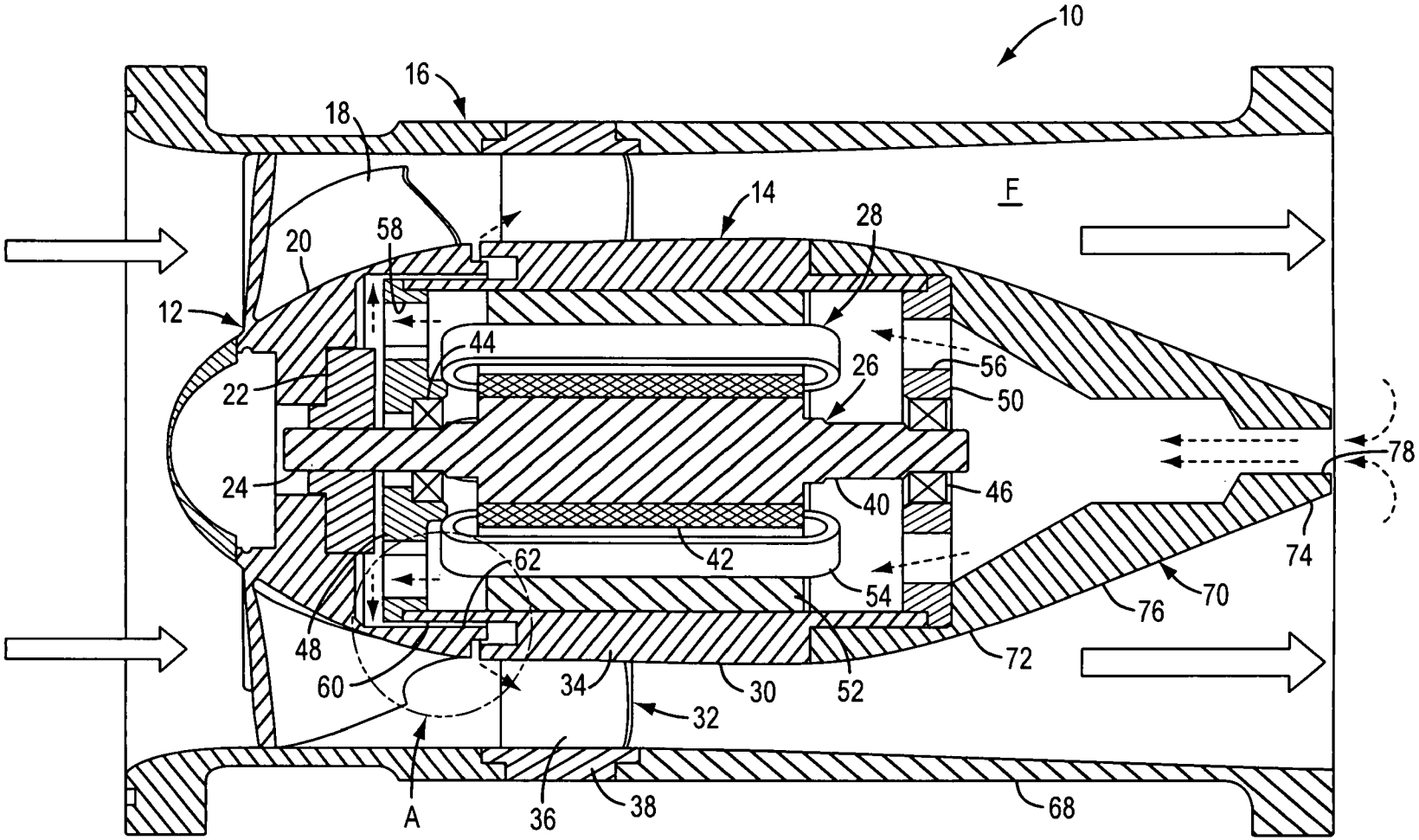
FIG. 1 is a longitudinal cross sectional view of an exemplary embodiment of the air mover of the present invention.

Referring to FIG. 1, the cooling fan of the present invention, which is indicated generally by reference number 10, includes an impeller 12 which is driven by a motor 14 that is mounted to a fan housing 16. In operation, the motor 14 spins the impeller 12 to draw a flow of air into and through the fan housing 16. This flow of air, which is represented in the figures by a series of large, solid-lined arrows, will be referred to herein as the main flow of air, or simply the main flow. The main flow traverses an annular flow path F, the outer boundary of which is defined by the fan housing 16 and the inner boundary of which is defined at least in part by the impeller 12 and the motor 14.

The impeller 12 comprises a number of fan blades 18 which are connected to or formed integrally with a hub 20. The hub 20 is connected to a collet 22 by suitable means, such a number of screws (not shown), and the collet is secured to a shaft 24 in a known fashion. The particular details of the impeller 12 and the means by which it is connected to the shaft 24 are not necessary for an understanding of the present invention.

The motor 14 may comprise an induction motor, a brushless DC motor, a brushed DC motor, or any other type of motor which is known in the art. Also, the motor 14 may include a laminated metal core or an air core. Air core motors are often used in high speed applications because they have no ferromagnetic core to generate losses at high driving frequencies. However, the windings of air core motors are poorly coupled to the motor housing. Consequently, the heat generated by these motors cannot be effectively dissipated into the surrounding air stream. Thus, the present invention is especially useful for fans which comprise air core motors.

In the exemplary embodiment of the invention which is shown in the drawings, the motor 14 comprises brushless DC motor which includes a rotor 26 that is surrounded by a stator 28 which is mounted in a cylindrical motor housing 30. The motor housing 30 is connected to the fan housing 16 by, for example, a conventional outlet guide vane assembly 32. The outlet guide vane assembly 32 includes a hub 34 which is attached to or formed integrally with the motor housing 30, a plurality of outlet guide vanes 36 which extend radially outwardly from the hub, and an outer ring 38 which is attached to the distal ends of the outlet guide vanes and is connected to the fan housing 16 by suitable means.

The rotor 26 includes a cylindrical axle 40 which is connected to or formed integrally with the shaft 24 and a number of magnets 42 which are attached to the outer diameter surface of the axle. The axle 40 is rotationally supported in a pair of front and rear bearings 44, 46. The front bearing 44 is mounted to a front end cap 48 which is connected to the upstream end of the motor housing 30 and the rear bearing 46 is mounted to a rear end cap 50 which is connected to the downstream end of the motor housing. The stator 28 includes a yoke 52 which is positioned around the magnets and a plurality of coils 54 which are wound upon the yoke. In addition, the yoke 52 is attached to the motor housing 30 in a known fashion to thereby maintain the stator 28 rotationally fixed relative to the fan housing 16.

In operation of the cooling fan 10, the spinning impeller 12 draws air into the fan housing 16 and forces it through the outlet guide vane assembly 32. As the air passes through the outlet guide vane assembly 32, the guide vanes 36 de-swirl the air and convert the dynamic pressure generated by the impeller 12 into static pressure. As a result, the static pressure of the air proximate the downstream end of the motor 14 is greater than the static pressure of the air proximate the upstream end of the motor.

In accordance with the present invention, this pressure difference between the upstream and downstream ends of the motor 14 is used to induce a portion of the main flow, which is defined as the bleed stream and is depicted in the drawings by the series of broken-line arrows, to flow back through the motor and cool the motor through the process of forced convection. In particular, the motor 14 includes an inlet opening proximate its downstream end and an outlet opening proximate its upstream end, and the pressure difference between the upstream and downstream ends causes a bleed stream to separate from the main flow and flow into the inlet opening, through the motor and out the outlet opening, where it rejoins the main flow through the flow path F.

The proportion of the main flow which comprises the bleed stream will depend in part on the particular cooling requirements of the motor 14. However, in many applications the bleed stream will comprise less than about 5% of the main flow. Moreover, a desired flow rate for the bleed stream can be established by properly sizing the inlet and outlet openings, and any passages connecting the inlet and outlet openings, in order to provide a desired impedance to the bleed stream.

In the exemplary embodiment of the invention illustrated in FIG. 1, the motor 14 includes a number of inlet openings 56 which are formed in the rear end cap 50 and a number of outlet openings 58 which are formed in the front end cap 48. In operation, the bleed stream is drawn into the inlet openings 56, through the motor 14 and out the outlet openings 58. As the bleed stream passes through the motor 14, it absorbs heat from the various heat-producing components of the motor 14, such as the rotor 26, the stator 28 and the bearings 44, 46. The bleed stream then reenters the flow path F at a point upstream of the inlet openings 56 and is expelled with the main flow through the rear of the fan housing 16.

Figure 2:
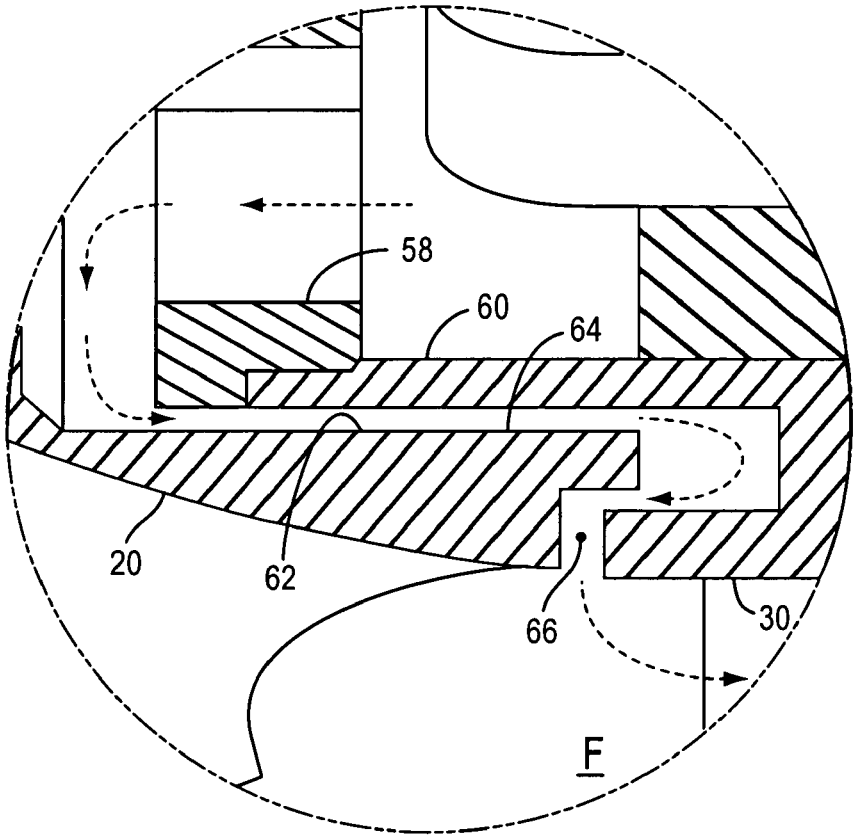
FIG. 2 is an enlarged view of the portion of the fan of FIG. 1 designated "A"

After the bleed stream passes through the outlet openings 58, it may take any of a variety of paths through the cooling fan 10 before it reenters the flow path F. As shown in FIG. 1, for example, after the bleed stream passes through the outlet openings 58, it passes between the front end cap 48 and the impeller hub 20 and reenters the flow path F immediately downstream of the impeller 12. In this regard, the motor housing 30 may include a cylindrical front extension 60 to which the front end cap 48 is connected, and the impeller hub 20 may include a corresponding recess 62 within which the front extension is received. This arrangement will create a labyrinth passageway which will partially restrict and guide the bleed stream. As shown more clearly in FIG. 2, after the bleed stream passes through the exit openings 58, it flows through an axial annulus 64 between the front extension 60 and the recess 62 and out through a radial annulus 66 between the motor housing 30 and the impeller hub 20 before it reenters the flow path F.

Referring still to FIG. 1, the cooling fan 10 may also include an optional diffuser section which comprises a diffuser tube 68 and a tail cone 70 through which the bleed stream passes before it enters the inlet openings 56. The diffuser tube 68 may be connected to the fan housing 16 or the outer ring 38 of the outlet guide vane assembly 32 by any suitable means, and when the diffuser tube 68 is connected as shown in FIG. 1, it forms an extension of the fan housing 16. The tail cone 70 comprises a first end 72 which is connected to the motor housing 30, a second end 74 which is located downstream of the first end, and an annular outer surface 76 which converges from the first end toward the second end. In addition, the tail cone 70 may include at least one aperture 78 which extends through the tail cone and communicates with the inlet openings 56 in the rear end cap 50. For example, the aperture 78 may extend axially through the second end 74 of the tail cone 70.

In operation of this embodiment of the cooling fan 10, the bleed stream is drawn through the aperture 78, the inlet openings 56 and the motor 14 and then expelled back into the flow path F through the outlet openings 58, the axial annulus 64 and the radial annulus 66. The diffuser section is especially effective in converting the relatively low static pressure head in the area of the impeller 12 into a relatively high static pressure head. In addition, the air in the vicinity of the aperture 78 typically has a reduced particle count due to the centrifugal action of the impeller 12 on the main flow. Consequently, the bleed stream will be less likely to foul the internal components of the motor 14.

Figure 3:
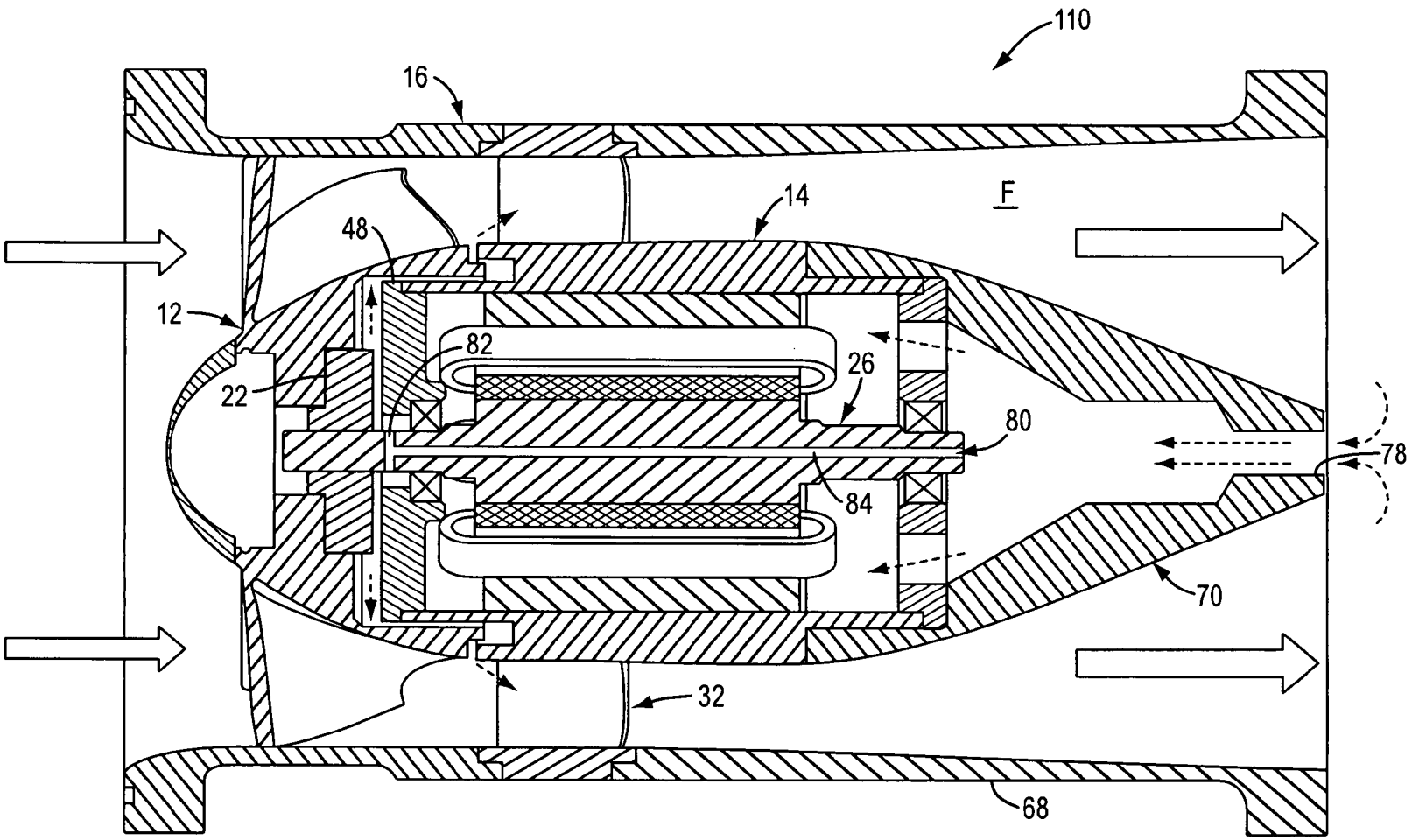
FIG. 3 is a longitudinal cross sectional view of a second embodiment of the air mover of the present invention.

Another embodiment of the present invention is illustrated in FIG. 3. The cooling fan of this embodiment, which is indicated generally by reference number 110, is similar in many respects to the cooling fan 10 described above. However, in this embodiment the motor 14 comprises an axial inlet opening 80 in the downstream end of the rotor 26, one or more radial outlet openings 82 proximate the upstream end of the rotor, and a flow bore 84 which extends axially through the rotor between the inlet opening and the outlet openings. The outlet openings 82 communicate with the space between the collet 22 and the front end cap 48, which in turn communicates with the flow path F in a manner similar to that described in connection with the cooling fan 10. Thus, in this embodiment the electrical components of the motor are totally enclosed and are therefore not exposed to the external air.

In operation of the cooling fan 110, the bleed stream enters the inlet opening 80 and flows through the flow bore 84, where it absorbs the heat of the various motor components that has been conducted through the rotor 26. The bleed stream then flows out the exit openings 82 and rejoins the flow path F immediately downstream of the impeller 12. Since the bleed stream passes through the rotor 26, it is prevented from contacting the coils 54, which may be subject to corrosion if exposed to external air. In addition, this embodiment of the invention is especially useful for induction motors comprising heat-generating conductors and laminations mounted on the rotor, since the heat generated by these components can be readily transmitted through the rotor to the bleed stream.

Figure 4:
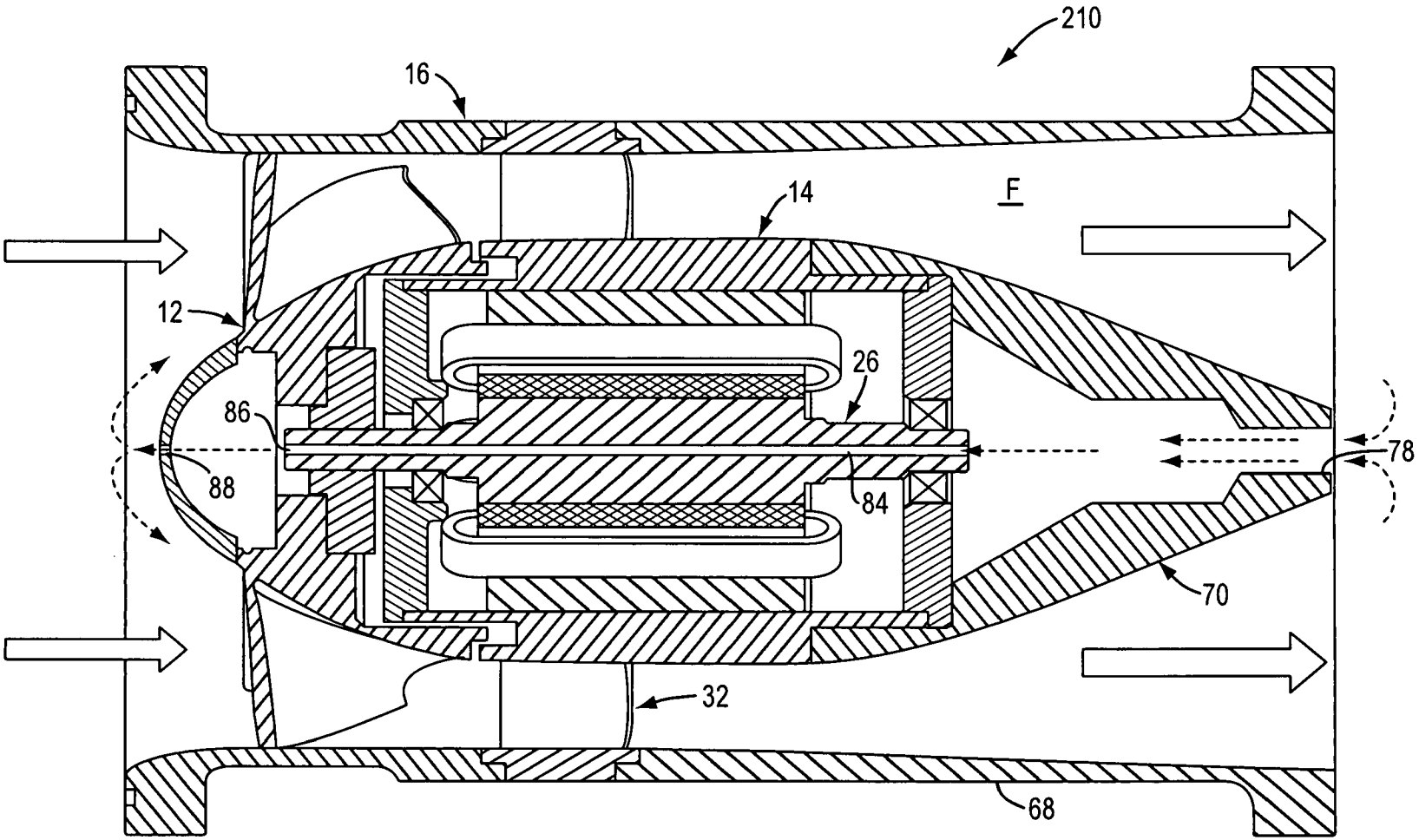
FIG. 4 is a longitudinal cross sectional view of a third embodiment of the air mover of the present invention.

Yet another embodiment of the present invention is illustrated in FIG. 4. The cooling fan of this embodiment, which is indicated generally by reference number 210, is similar in many respects to the cooling fan 110 described above. However, instead of or in addition to the radial exit openings 82, in this embodiment the motor 14 comprises an axial exit opening 86 in the upstream end of the rotor 26, or more precisely, the shaft 24. In addition, the exit opening 86 communicates with the flow path F through one or more holes 88 in the impeller 12. In operation of the cooling fan 210, therefore, the bleed stream is drawn into the inlet opening 80, through the flow bore 84, out the exit opening 86 and back into the flow path through the hole 88.

Figure 5:
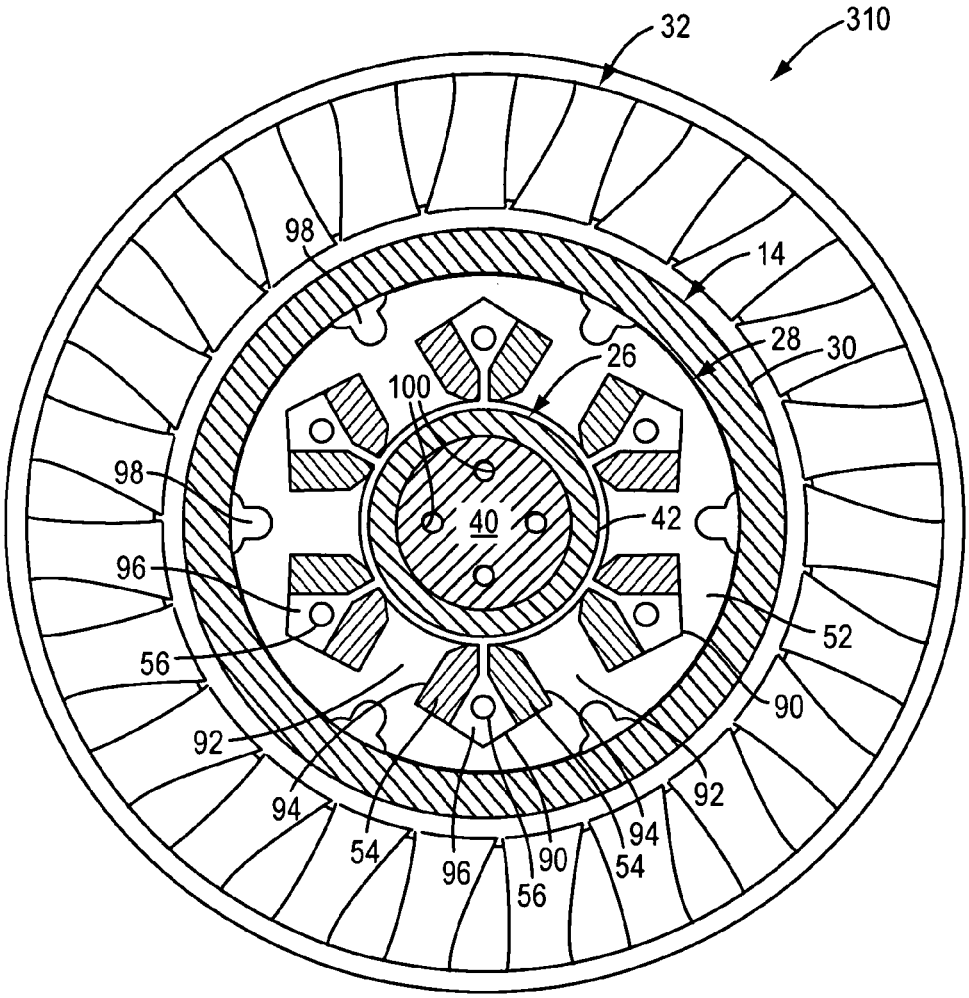
FIG. 5 is an axial cross sectional view of a fourth embodiment of the air mover of the present invention.

Another embodiment of the present invention is shown in FIG. 5. The cooling fan of this embodiment, which is indicated generally by reference number 310, is similar in many respects to the cooling fan 10 described above and can therefore be considered a modification of this cooling fan. However, in this embodiment the cooling fan 310 includes a number of defined cooling passages through the motor 14 to facilitate the removal of heat from the internal motor components. As shown in FIG. 5, the motor 14 includes an axial rotor 26 which is surrounded by a stator 28 that in turn is mounted in a motor housing 30. The rotor 26 includes a cylindrical axle 40 and a number of magnets 42 which are attached to the outer diameter surface of the axle. The stator 28 includes a yoke 52 which comprises a stack of laminations, a number of axial slots 90 which define a plurality of radially extending teeth 92 around which the stator coils 54 are wound, and a number of slot liners 94 which are positioned in the slots between the stator coils and the teeth.

Since the slot liners 94 present a thermal barrier between the stator coils 54 and the yoke 52, the ability to remove heat directly from the stator coils is highly desirable. Accordingly, in one embodiment of the invention the cooling fan 310 may include a number of coil cooling passages 96 for directing the bleed stream over the stator coils 54. Each coil cooling passage 96 is defined as the axially-extending space between the pair of stator coils 54 which occupies a particular slot 92. The coil cooling passages 96 are created by forming the stator coils 54 with less than the maximum number of winds than the slots 90 can accommodate. Thus, the stator coils 54 will occupy only a portion of the cross sectional area of the slot 90.

The cross sectional area of each coil cooling passage 96 may comprise between about 10% and 60% of the cross sectional area of the slot 90. Preferably, the cross sectional area of each coil cooling passage 96 will comprise between about 20% and 30% of the cross sectional area of the slot 90. In addition, the coil cooling passages 96 are ideally aligned with the inlet and outlet openings 56, 58 in the front and rear end 48, 50 of the motor housing 30 to facilitate the flow of the bleed stream through the motor 14.

In addition or as an alternative to the coil cooling passages 96, the cooling fan 310 may comprise a number of stator cooling passages 98 which extend axially through the stator yoke 52. The stator cooling passages 98 can comprise slots which are formed in the outer diameter surface of the yoke 52, slots which are formed in the inner diameter surface of the yoke, holes **98*a* which are located between the inner and outer diameter surfaces of the yoke, or any combination of such slots and holes. In either case, the stator cooling passages 98, 98*a* are preferably located where they will have little impact on the distribution and magnitude of the flux in the motor 14. In addition, in the event the motor 14 is designed to be totally enclosed, a corresponding tube may be secured within each stator cooling passage 98 to ensure that the rotor magnets 42 and the stator coils 54 will remain isolated from the bleed stream. As shown in FIG. 5, for example, each hole 98*a* has a corresponding tube 98*b*** inserted therein.

In addition or as an alternative to the coil cooling passages 96 and the stator cooling passages 98, the cooling fan 310 may comprise a number of rotor cooling passages 100 which extend generally axially through the rotor axle 40 inboard of the rotor magnets 42.

In operation of the cooling fan 310, the pressure difference between the upstream and downstream ends of the motor 14 draws the bleed stream into the motor housing 30 and through one or more of the cooling passages described above, such as the coil cooling passages 96, the stator cooling passages 98 or the rotor cooling passages 100. As the bleed stream passes through these cooling passages, it absorbs the heat generated by the internal motor components and then reenters the flow path F in a manner described above.

Figure 6:
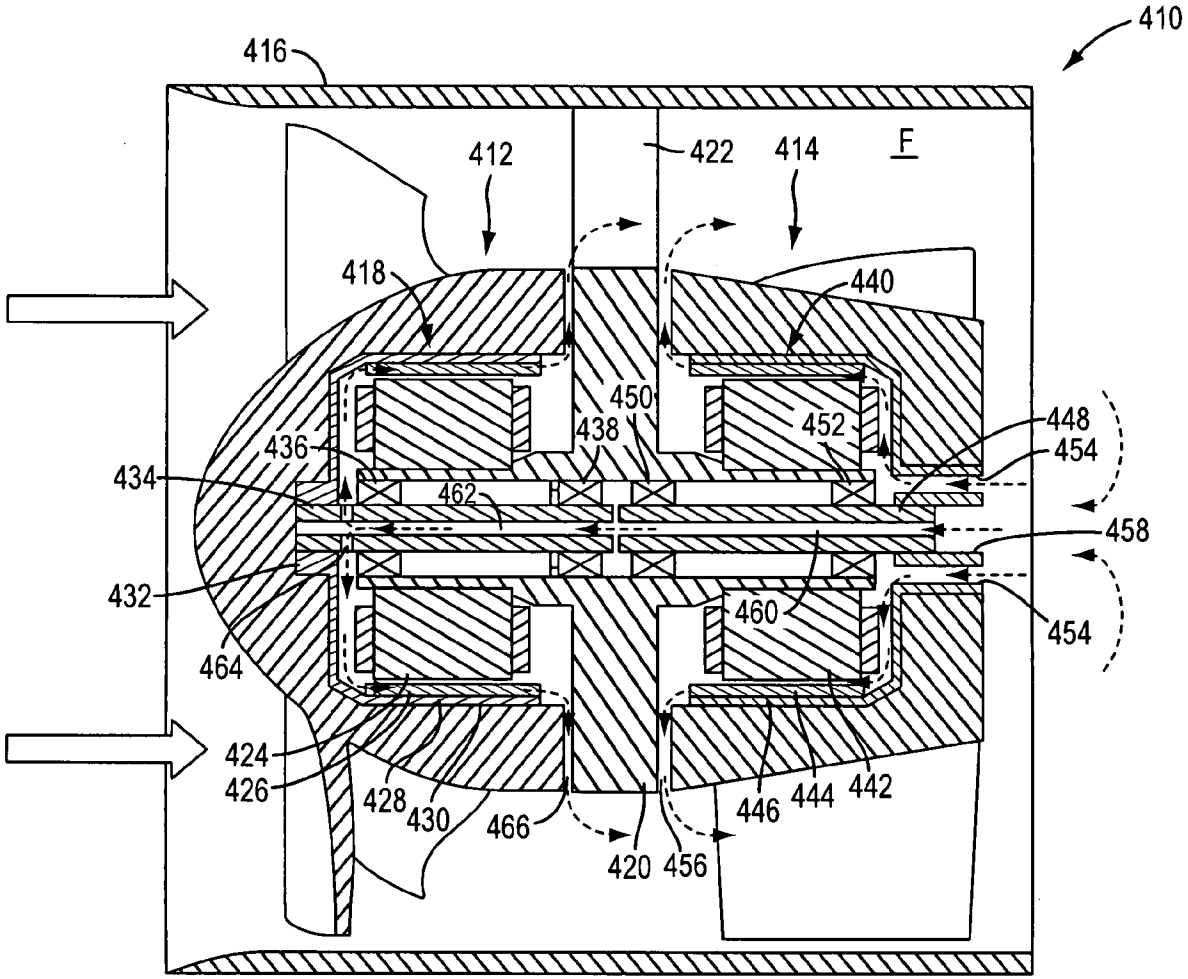
FIG. 6 is an axial cross sectional view of a fifth embodiment of the air mover of the present invention.

A further embodiment of the cooling fan of the present invention is shown in FIG. 6. The cooling fan of this embodiment, which is indicated generally by reference number 410, comprises both an upstream impeller 412 and a counter-rotating downstream impeller 414 mounted in a common fan housing 416. The downstream impeller 414 functions in a manner similar to the outlet guide vane assembly 32 discussed above to de-swirl the air stream from the upstream impeller 412 and convert the dynamic pressure of the air stream into static pressure.

The upstream impeller 412 is driven by an upstream motor 418 which is supported on an bearing caddy 420 that is connected to the fan housing 416 by a radial strut 422. The upstream motor 418 includes an inner stator 424 which is mounted to the bearing caddy 422, an outer rotor 426 which is positioned around the stator, and a rotor cup 428 which is attached to the rotor. The rotor cup 428 is mounted in a corresponding recess 430 in the upstream impeller 412 and includes a front end portion 432 which is connected to an upstream motor shaft 434 that is rotationally supported within the bearing caddy 420 by a pair of front and rear upstream bearings 436, 438. Accordingly, when the coils of the stator 424 are energized, the rotor 426 and the rotor cup 428 will rotate and thereby spin the upstream impeller 412.

The downstream impeller 414 is driven by a downstream motor 440 which is similar to the upstream motor 418. Thus, the downstream motor 440 comprises an inner stator 442 which is mounted to the bearing caddy 420, an outer rotor 444 which is mounted to a rotor cup 446 that in turn is secured within a corresponding recess in the downstream impeller 414, and a downstream motor shaft 448 which is connected to the rotor cup and is rotationally supported within the bearing caddy 420 by a pair of front and rear downstream bearings 450,452. In this manner, when the coils of the stator 442 are energized, the rotor 444 and the rotor cup 446 will rotate and thereby spin the downstream impeller 414.

In operation, the upstream impeller 412 draws air into the fan housing 416 and forces it through the downstream impeller 414. As the air passes through the counter-rotating downstream impeller 414, the air is de-swirled its dynamic pressure is converted into a static pressure. Consequently, the static pressure of the air downstream of the downstream impeller 414 is greater than the static pressure of the air upstream of the downstream impeller.

In accordance with the present invention, the cooling fan 410 uses this pressure difference between the upstream and downstream ends of the downstream impeller 414 to induce a bleed stream to flow back through the downstream impeller and cool the downstream motor 440 by the process of forced convection. Thus, the cooling fan 410 also includes means to enable a bleed stream to flow through the downstream motor 440. As shown in FIG. 6, these means may include one or more inlet openings 454 which are formed in a rear portion of the downstream rotor cup 446 and an outlet opening 456 which is defined by an annular gap between the downstream impeller 414 and the bearing caddy 420. In this embodiment, a pressure difference exists between the outlet opening 456, which is located upstream of the downstream impeller 414, and the inlet openings 454, which are effectively located downstream of the downstream impeller. Accordingly, this pressure difference forces the bleed stream, which is depicted by the broken-line arrows in FIG. 6, to flow into the inlet openings 454, through the stator 442 and the rotor 444, and back into the flow path F through the outlet opening 456.

In accordance with another aspect of the present invention, the cooling fan 410 uses the pressure difference between the upstream and downstream ends of the downstream impeller 414 to induce a bleed stream to flow back through the upstream impeller 412 and cool the upstream motor 418 by the process of forced convection. Thus, the cooling fan 410 additionally includes means to enable a bleed stream to flow through the upstream motor 418. As shown in FIG. 6, these means may include an inlet opening 458 which is formed in a rear portion of the downstream rotor cup 446, a first flow bore 460 which extends axially through the downstream motor shaft 448, a second flow bore 462 which extends axially through the upstream motor shaft 434, a number of radial openings 464 which extend between the second flow bore and the interior of the upstream rotor cup 428, and an outlet opening 466 which is defined by an annular gap between the upstream impeller 412 and the bearing caddy 420. In this embodiment, a pressure difference exists between the outlet opening 466, which is located upstream of the downstream impeller 414, and the inlet opening 458, which is effectively located downstream of the downstream impeller. Accordingly, this pressure difference forces the bleed stream into the inlet opening 458, through the first and second flow bores 460, 462, out the radial openings 464, through the stator 424 and the rotor 426, and back into the flow path through the outlet opening 466.

In a variation of this embodiment of the invention, which is not illustrated in FIG. 6, the cooling fan 410 may comprise a diffuser section similar to the diffuser section for the cooling fan 10 described above. In this variation, the diffuser section includes a diffuser tube 68 which is connected to or formed integrally with the downstream end of the fan housing 416 and a tail cone 70 which is positioned axially within the diffuser tube. For example, the tail cone 70 may be connected to the diffuser tube 68 with one or more radial struts. In addition, the tail cone may comprise one or more apertures 78 which provide for communication between the flow path F and the inlet openings 454, 458. This diffuser section will act to further increase the static pressure differential between the upstream and downstream ends of the downstream impeller 414 which will drive a larger quantity of bleed flow than the embodiment of the cooling fan without the diffuser section.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

What is claimed is:

1. An air mover which comprises:

a tubular fan housing;

a motor which includes a motor housing;

a shaft which is driven by the motor;

an impeller which includes an impeller hub that is connected to the shaft proximate an upstream end of the motor housing;

an outlet guide vane assembly which is positioned downstream of the impeller and which includes a guide vane hub that is connected to or formed integrally with the motor housing and a plurality of guide vanes that extend between the guide vane hub and the fan housing;

a diffuser section which is positioned downstream of the outlet guide vane assembly and which includes a diffuser tube that is connected to or formed integrally with the fan housing and a tail cone that is connected to or formed integrally with a downstream end of the motor housing, the tail cone comprising a downstream end and an aperture which extends axially through the downstream end to a location downstream of the tail cone;

wherein during operation of the air mover, the motor spins the impeller to generate a flow of air through a flowpath which comprises an outer boundary defined by the fan housing and the diffuser tube and an inner boundary defined by the impeller hub, the guide vane hub and the tail cone;

the motor comprising at least one inlet opening proximate the downstream end of the motor housing which is in fluid communication with the aperture and at least one outlet opening proximate the upstream end of the motor housing which is in fluid communication with a portion of the flowpath located upstream of the outlet guide vane assembly;

wherein during operation of the air mover, a pressure difference between the aperture and the outlet opening causes a portion of the flow of air to flow into the aperture, through the inlet opening and out the outlet opening to thereby cool the motor;

wherein the motor further comprises a front end cap which is connected to an upstream end of the motor housing, a rear end cap which is connected to a downstream end of the motor housing, and a rotor which is connected to or formed integrally with the shaft and is rotationally supported by a front bearing mounted in the front end cap and a rear bearing mounted in the rear end cap;

wherein the at least one inlet opening is formed in the rear end cap and the at least one outlet opening is formed in the front end cap; and wherein the motor housing comprises an axially extending front extension which is positioned in an axial recess in the impeller hub, and wherein the outlet opening communicates with the flowpath through an annular space between the front extension and the recess.

2. An air mover which comprises:

a tubular fan housing;

a motor which includes a motor housing;

a shaft which is driven by the motor;

an impeller which includes an impeller hub that is connected to the shaft proximate an upstream end of the motor housing;

an outlet guide vane assembly which is positioned downstream of the impeller and which includes a guide vane hub that is connected to or formed integrally with the motor housing and a plurality of guide vanes that extend between the guide vane hub and the fan housing;

a diffuser section which is positioned downstream of the outlet guide vane assembly and which includes a diffuser tube that is connected to or formed integrally with the fan housing and a tail cone that is connected to or formed integrally with a downstream end of the motor housing, the tail cone comprising a downstream end and an aperture which extends axially through the downstream end to a location downstream of the tail cone;

wherein during operation of the air mover, the motor spins the impeller to generate a flow of air through a flowpath which comprises an outer boundary defined by the fan housing and the diffuser tube and an inner boundary defined by the impeller hub, the guide vane hub and the tail cone:

the motor comprising at least one inlet opening proximate the downstream end of the motor housing which is in fluid communication with the aperture and at least one outlet opening proximate the upstream end of the motor housing which is in fluid communication with a portion of the flowpath located upstream of the outlet guide vane assembly;

wherein during operation of the air mover, a pressure difference between the aperture and the outlet opening causes a portion of the flow of air to flow into the aperture, through the inlet opening and out the outlet opening to thereby cool the motor;

wherein the motor further comprises a rotor which is connected to or formed integrally with the shaft, and wherein the inlet opening is formed in a downstream portion of the rotor, the outlet opening is formed in an upstream portion of the rotor and the inlet and outlet openings are connected by a flow bore which extends axially through the rotor;

wherein the motor further comprises a front end cap which is connected to an upstream end of the motor housing and a rear end cap which is connected to a downstream end of the motor housing;

wherein the rotor is rotationally supported by the front and rear end caps;

wherein the outlet opening communicates with the flowpath through a space between the impeller hub and the front end cap; and wherein the motor housing comprises an axially extending front extension which is positioned in an axial recess in the impeller hub, and wherein the outlet opening communicates with the flowpath through an annular space between the front extension and the recess.

3. An air mover which comprises:

a tubular fan housing;

a motor which includes a motor housing;

a shaft which is driven by the motor;

an impeller which includes an impeller hub that is connected to the shaft proximate an upstream end of the motor housing;

an outlet guide vane assembly which is positioned downstream of the impeller and which includes a guide vane hub that is connected to or formed integrally with the motor housing and a plurality of guide vanes that extend between the guide vane hub and the fan housing;

a diffuser section which is positioned downstream of the outlet guide vane assembly and which includes a diffuser tube that is connected to or formed integrally with the fan housing and a tail cone that is connected to or formed integrally with a downstream end of the motor housing, the tail cone comprising a downstream end and an aperture which extends axially through the downstream end to a location downstream of the tail cone;

wherein during operation of the air mover, the motor spins the impeller to generate a flow of air through a flowpath which comprises an outer boundary defined by the fan housing and the diffuser tube and an inner boundary defined by the impeller hub, the guide vane hub and the tail cone;

the motor comprising at least one inlet opening proximate the downstream end of the motor housing which is in fluid communication with the aperture and at least one outlet opening proximate the upstream end of the motor housing which is in fluid communication with a portion of the flowpath located upstream of the outlet guide vane assembly;

wherein during operation of the air mover, a pressure difference between the aperture and the outlet opening causes a portion of the flow of air to flow into the aperture, through the inlet opening and out the outlet opening to thereby cool the motor; and wherein the motor includes a stator which comprises:

a yoke which comprises a radially inner surface, a radially outer surface and a number of axially extending slots that define a plurality of radially extending teeth;

a number of stator coils which are wound around the teeth; and at least one stator cooling passage which extends axially through the stator and provides for fluid communication between the inlet and outlet openings.

4. The air mover of claim 3, wherein the stator cooling passage comprises at least one slot which is formed on the radially outer surface of the yoke.

5. The air mover of claim 3, wherein the stator cooling passage comprises at least one slot which is formed on the radially inner surface of the yoke.

6. An air mover which comprises:

a tubular fan housing;

a motor which includes a motor housing;

a shaft which is driven by the motor;

an impeller which includes an impeller hub that is connected to the shaft proximate an upstream end of the motor housing;

an outlet guide vane assembly which is positioned downstream of the impeller and which includes a guide vane hub that is connected to or formed integrally with the motor housing and a plurality of guide vanes that extend between the guide vane hub and the fan housing;

a diffuser section which is positioned downstream of the outlet guide vane assembly and which includes a diffuser tube that is connected to or formed integrally with the fan housing and a tail cone that is connected to or formed integrally with a downstream end of the motor housing, the tail cone comprising a downstream end and an aperture which extends axially through the downstream end to a location downstream of the tail cone;

wherein during operation of the air mover, the motor spins the impeller to generate a flow of air through a flowpath which comprises an outer boundary defined by the fan housing and the diffuser tube and an inner boundary defined by the impeller hub, the guide vane hub and the tail cone;

the motor comprising at least one inlet opening proximate the downstream end of the motor housing which is in fluid communication with the aperture and at least one outlet opening proximate the upstream end of the motor housing which is in fluid communication with a portion of the flowpath located upstream of the outlet guide vane assembly;

wherein during operation of the air mover, a pressure difference between the aperture and the outlet opening causes a portion of the flow of air to flow into the aperture, through the inlet opening and out the outlet opening to thereby cool the motor; and wherein the motor includes a stator which comprises:

a yoke which comprises a number of axially extending slots that define a plurality of radially extending teeth;

a number of stator coils which are wound around the teeth such that portions of two stator coils are disposed in each slot; and at least one coil cooling passage which extends through a corresponding slot between the stator coils and provides for fluid communication between the inlet and outlet openings.

7. The air mover of claim 6, wherein the cross sectional area of the coil cooling passage comprises between about 10% and 60% of the cross sectional area of the slot.

8. The air mover of claim 6, wherein the cross sectional area of each coil cooling passage comprises between about 20% and 30% of the cross sectional area of the slot.

9. An air mover which comprises:

a fan housing;

a first motor which includes a first rotor;

a first impeller which is connected to the first rotor and is driven by the first motor to generate a flow of air through a flowpath which comprises an outer boundary that is defined at least in part by the fan housing;

the first rotor comprising a first inlet opening which is formed in a downstream portion of the first rotor, a first outlet opening which is formed in an upstream portion of the first rotor, and a first flow bore which extends axially through the first rotor between the first inlet and outlet openings, each of the first inlet and outlet openings being in fluid communication with the flowpath;

wherein during operation of the air mover, a pressure difference between the first inlet and outlet openings causes a portion of the flow of air to flow into the first inlet opening, through the first flow bore and out the first outlet opening to thereby cool the first motor; and wherein the first impeller is connected to the first rotor adjacent an upstream end of the first motor, and wherein the first outlet opening communicates with the flowpath through a space between the first impeller and the first motor.

10. An air mover which comprises:

a fan housing;

a first motor which includes a first rotor;

a first impeller which is connected to the first rotor and is driven by the first motor to generate a flow of air through a flowpath which comprises an outer boundary that is defined at least in part by the fan housing;

the first rotor comprising a first inlet opening which is formed in a downstream portion of the first rotor, a first outlet opening which is formed in an upstream portion of the first rotor, and a first flow bore which extends axially through the first rotor between the first inlet and outlet openings, each of the first inlet and outlet openings being in fluid communication with the flowpath;

wherein during operation of the air mover, a pressure difference between the first inlet and outlet openings causes a portion of the flow of air to flow into the first inlet opening, through the first flow bore and out the first outlet opening to thereby cool the first motor;

a second motor which includes a second rotor;

a second impeller which is connected to the second rotor and is driven by the second motor in a direction opposite to that of the first impeller;

the second rotor comprising a second inlet opening which is formed in a downstream portion of the second rotor, a second outlet opening which is formed in an upstream portion of the second rotor, and a second flow bore which extends axially through the second rotor between the second inlet and outlet openings, the second inlet opening being in fluid communication with the first outlet opening and the second outlet opening being in fluid communication with the flowpath;

wherein during operation of the air mover, a pressure difference between the first inlet opening and the second outlet opening causes a portion of the flow of air to flow into the first inlet opening, through the first and second flow bores and out the second outlet opening to thereby cool the first and second motors.

11. The air mover of claim 10, wherein the second outlet opening communicates with the flowpath through a space between the second motor and the second impeller.

* * * * *